US005711576A

United States Patent [19]

Olson et al.

[11] Patent Number: 5,711,576

[45] Date of Patent: Jan. 27, 1998

[54] BACK HEIGHT ADJUSTMENT MECHANISM FOR A CHAIR

[75] Inventors: Ogden R. Olson, Muscatine; Loren M. Simmons, Wabello, both of Iowa

[73] Assignee: HON Industries Inc., Muscatine, Iowa

[21] Appl. No.: 647,866

[22] Filed: May 15, 1996

Related U.S. Application Data

[62] Division of Ser. No. 375,645, Jan. 20, 1995, Pat. No. 5,542,743.

[51] Int. Cl.[6] ..... B60N 2/22

[52] U.S. Cl. ..... 297/353; 297/411.36

[58] Field of Search ..... 297/353, 411.36, 297/410, 452.14

[56] References Cited

U.S. PATENT DOCUMENTS

| | | | |
|---|---|---|---|
| 2,577,050 | 12/1951 | Van Buren | 297/353 |
| 2,599,301 | 6/1952 | Van Buren | 297/353 |
| 2,784,769 | 3/1957 | Fisher | 297/393 |

*Primary Examiner*—Peter M. Cuomo
*Assistant Examiner*—Stephen Vu
*Attorney, Agent, or Firm*—Jones, Day, Reavis & Pogue

[57] ABSTRACT

A low cost task chair comprises a blow molded seat support member having a central planar portion for attachment of a control bracket. A recess in the planar portion beneath the control bracket receives a cross brace. A pair of arm support frames are secured to the ends of the cross brace and to the control bracket. The arms are, therefore, easily assembled to the chair with the cross brace concealed from view. A pedestal is secured to the control bracket and contains a gas cylinder for raising and lowering the seat assembly. Another recess is formed in the seat support member for receiving a flush mounted cylinder actuating lever. A seat back adjustment mechanism for adjusting the outward position of the back relative to the seat comprises a pair of parallel spaced tubular members telescopingly received by the control bracket. A blow molded back support is provided with wedge-shaped channels for receiving a pair of tubular members of a back support frame, thereby providing for a back height adjustment feature.

4 Claims, 6 Drawing Sheets

BACK HEIGHT ADJUSTMENT MECHANISM FOR A CHAIR

This application is a divisional of U.S. patent application Ser. No. 08/375,645, filed on Jan. 20, 1995, now U.S. Pat. No. 5,542,743.

BACKGROUND OF THE INVENTION

1. Field of the Invention

The present invention relates generally to task chairs of the type used in office environments, for example, and it relates more specifically to a novel construction of a task chair which is highly functional and which is easily manufactured and assembled.

2. Description of the Prior Art

Numerous constructions of task chairs of the type used in office environments, for example, are known. A typical task chair has a cushioned seat and relatively low back. The chair is usually supported on a base having a plurality of casters to allow the chair to be easily moved about the work space. The chair may or may not have arms and other features such as adjustable seat and back height. Generally, known task chairs are of relatively inexpensive and lightweight construction.

The seat of the prior art chair now under consideration is typically an assembly of an upholstered foam cushion secured to a wood or injection molded plastic. The frame is bolted to a control bracket secured to a chair base. If the chair has an adjustable seat height feature, an actuator lever typically extends outwardly from the control bracket, surface mounted on the seat frame. In addition, if the chair has arms, the arms are typically supported by frame members surface mounted to the seat frame. If the chair has an adjustable height back, the mechanical adjustment mechanism is often exposed thereby detracting from the appearance of the chair. The use of a wood or injection molded seat frame with levers and arm frames surface mounted thereon can create a chair construction having an undesirable appearance because the various mechanical parts are exposed.

Accordingly, it is desirable to provide a task chair having an adjustable seat height feature in which an actuator lever is concealed. It is further desirable to provide a task chair having arm supports which are secured to the seat frame in a sturdy but essentially concealed manner. Still further it is desirable to provide a task chair having a back height adjustment mechanism which is reliable in use and also aesthetically pleasing in appearance. Even further it is desirable to provide a task chair which is economical to manufacture and which can be shipped in unassembled condition because it is easy to assemble at its destination.

SUMMARY OF THE INVENTION

The present invention overcomes the disadvantages of the prior art by providing a chair having a seat assembly which includes a blow molded seat support member. The support member has a central planar portion for attachment of a control bracket. A transverse recess is formed in the planar portion beneath the control bracket and receives a cross brace. A pair of arm support frames are secured to the ends of the cross brace and to the control bracket by screws. The arms are, therefore, easily assembled to the chair with the cross brace substantially concealed from view.

In another aspect of the invention, a pedestal is secured to the control bracket and contains a gas cylinder for raising and lowering the seat assembly. Another recess formed in the seat support member receives an actuating lever for actuating the gas cylinder. The actuating lever is substantially flush with the surface of the support member and thus is concealed from view.

In yet another aspect of the invention the chair is provided with a seat back adjustment mechanism for adjusting the outward position of the back relative to the seat. The adjustment mechanism comprises a pair of parallel spaced tubular members connected to the seat back and telescopingly received by the control bracket. A bolt extending through the control bracket cooperates with a clamp bar to clamp the tubular members to the control bracket.

Still another aspect of the invention relates to an adjustable height chair back wherein a blow molded back support member is provided with wedge-shaped channels for receiving a pair of tubular members of a back support frame. The tubular members may be adjusted to a variety of positions within the channels and clamped therein by a single bolt.

BRIEF DESCRIPTION OF THE DRAWINGS

The foregoing and other novel features of the invention will be better understood upon a reading of the following detailed description taken in conjunction with the accompanying drawings wherein.

DETAILED DESCRIPTION OF THE PREFERRED EMBODIMENT

Figure 1:
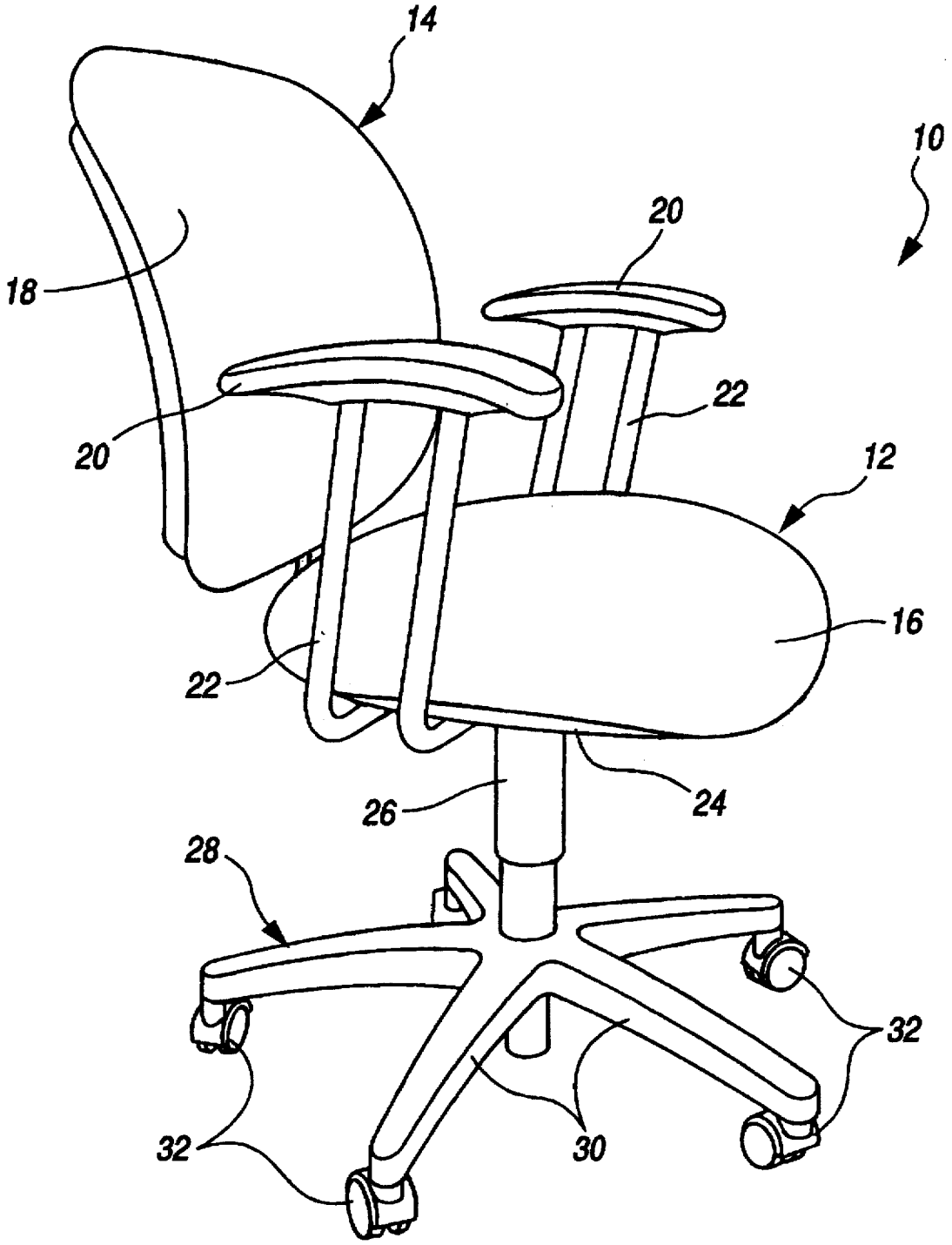
FIG. 1 is a side perspective view of a task chair constructed in accordance with the present invention.

Referring now to the drawings, and initially to FIG. 1, a task chair constructed in accordance with the invention is designated generally by the reference numeral 10 and includes a seat assembly 12 and a back assembly 14. In the embodiment illustrated, the seat assembly 12 and back assembly 14 include cushions, 16 and 18 respectively, covered by a suitable fabric. Arm pads 20 are supported by tubular frames 22. A seat support member 24, which will be described in detail hereinafter, is supported on a pedestal 26 which in turn is connected to a base 28. The base 28 comprises a plurality of legs 30 each fitted with a suitable castor 32 for ease in moving the chair 10 about the work space.

Figure 2:
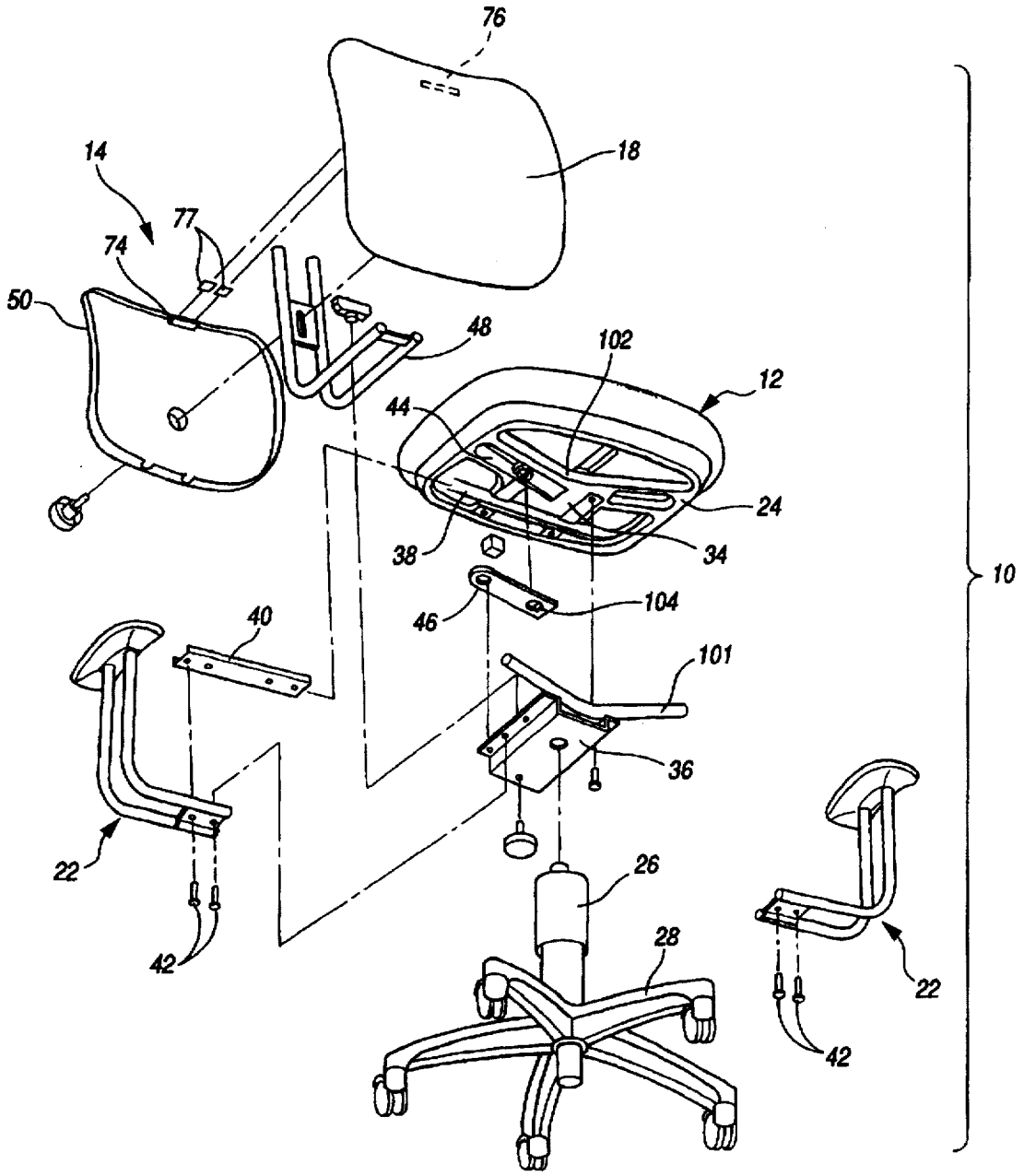
FIG. 2 is an exploded perspective of the task chair showing the construction of the underside of the seat.

FIG. 2 shows the underside of the chair 10 in exploded perspective. As seen therein, the seat support member 24 of the seat assembly 12 is blow molded from a suitable plastic and is formed with a central generally planar portion 34 to which a control bracket 36 is bolted. The control bracket 36 spans a transverse recess 38 in the support member 24. The recess 38 receives a cross brace 40 to which the arm frames 22 are connected by bolts 42. Another recess 44 is formed in the support member 24 leading from the center of the planar portion 34 to an edge of the support member 24. The recess receives an actuator lever 46 for purposes of which will be described hereinafter. The seat back assembly 14 is supported on the seat assembly 12 by a frame 48. A cover 50 is provided for the rear surface of the back assembly 14.

Figure 3:
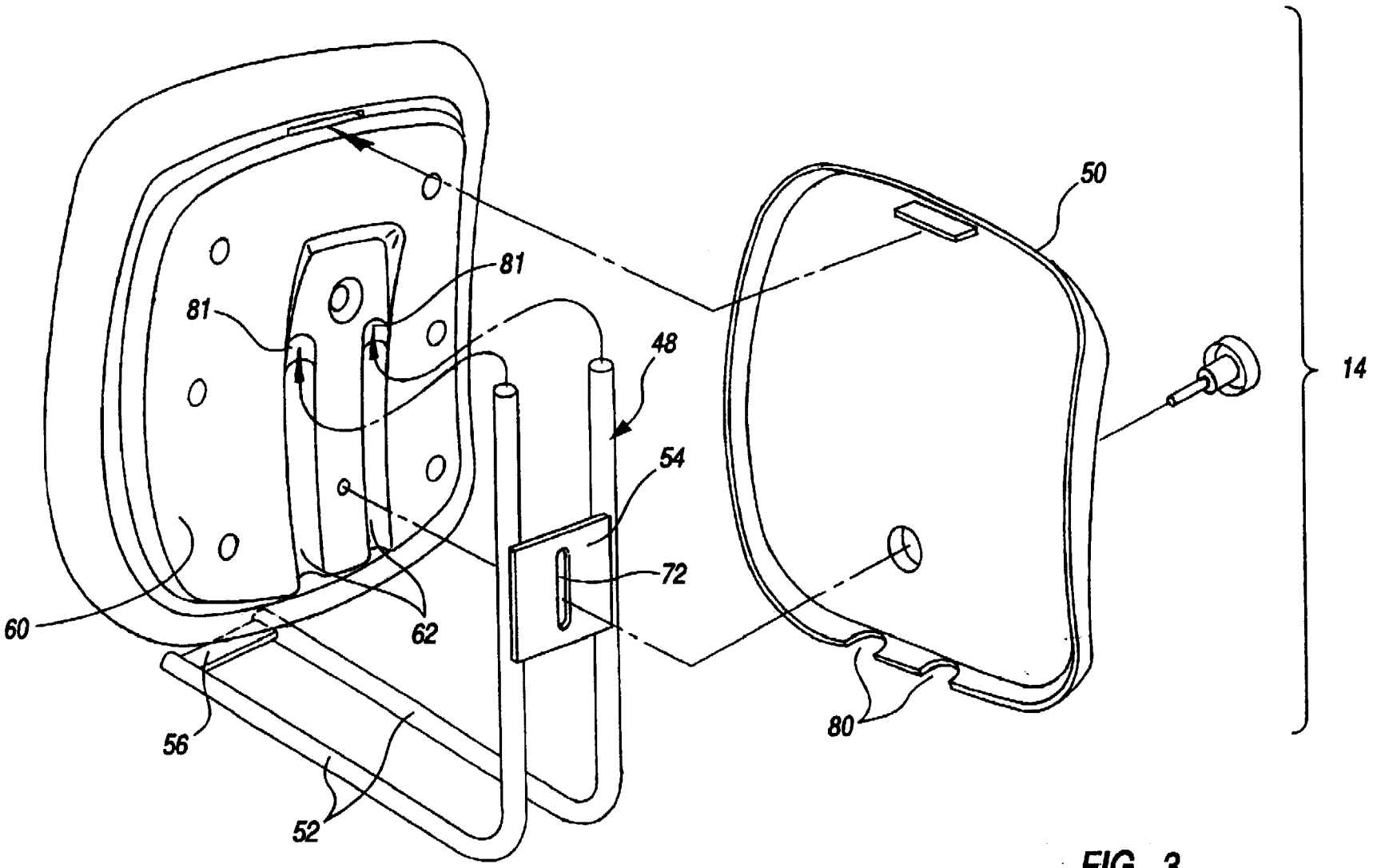
FIG. 3 is an exploded perspective view of the rear of the seat back.
Figure 4:
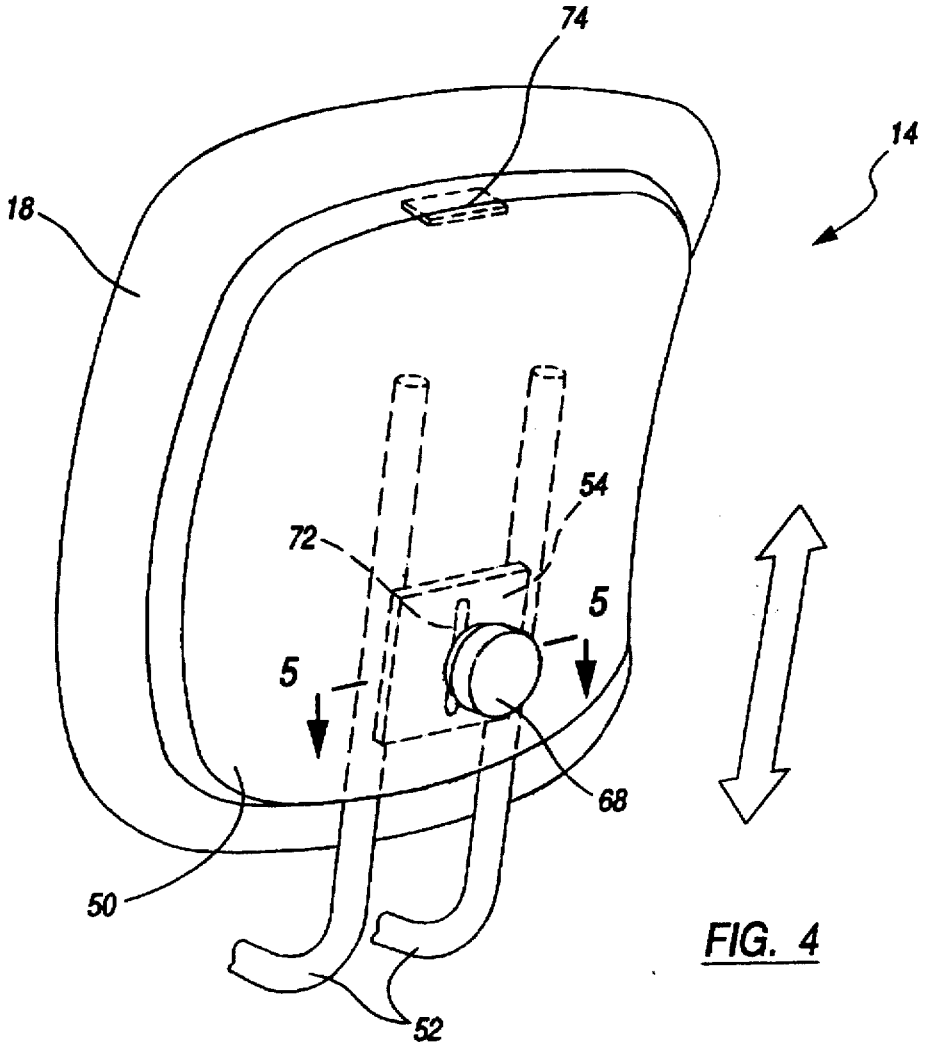
FIG. 4 is a perspective view of the rear of the seat back in assembled condition.
Figure 5:
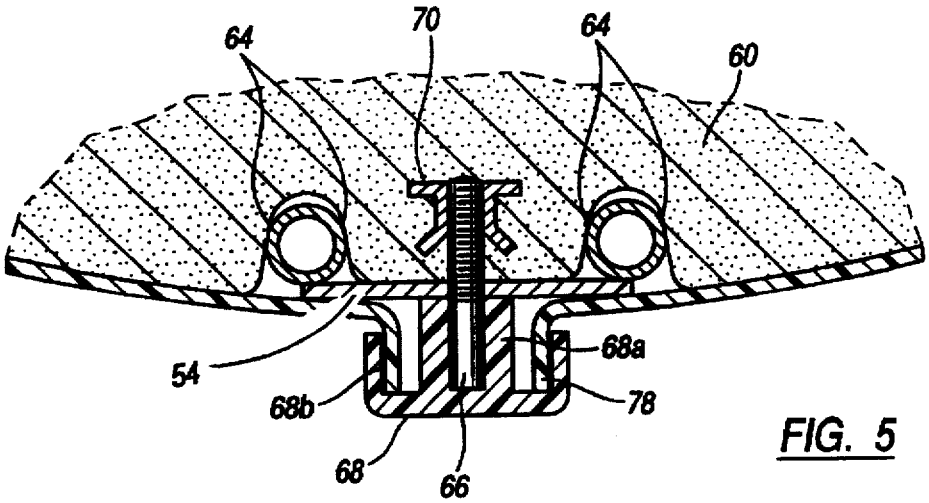
FIG. 5 is a partial cross-sectional view taken substantially along the line 5—5 of FIG. 4.

Turning now to FIGS. 3, 4 and 5, the seat back assembly 14 can be seen to have an adjustable height feature provided in part by a support frame 48 which includes two parallel spaced tubular members 52. The tubular members 52 are bent through approximately ninety degrees and are connected on first legs by a plate 54 and at opposite legs by a cross bar 56. The back assembly 14 in accordance with the invention includes a back support member 60 blow molded from a suitable plastic and formed with a pair of channels 62 running vertically from the lower edge of the support member 60. The channels 62 are spaced in such a manner as to slidingly receive the tubular members 52 of the frame 48. As best seen in FIG. 5, the channels 62 have wedge-shaped side walls 64. A bolt 66 capped by a knob 68 extends through the plate 54 and is threadedly received by a suitable fastener 70 molded into the back support member 60. A vertical slot 72 is provided in the plate 54 such that the back assembly has limited vertical movement relative to support frame 48. When the bolt 66 is screwed into the fastener 70, an inner cylindrical portion **68*a* of the knob 68 bears against the plate 54 forcing the tubular members 52 into wedging engagement with the side walls 64 of the channels 62 thereby locking the back support member 60 to the frame 48** at a desired vertical position.

The cover plate 50, which may be of metal or molded plastic construction, extends across the rear of the back support member 60. This cover 50 is held in place at the top by a tab 74 and slot 76 formed in the support member 60 and at the bottom by a collar 78 formed integral with the cover 50 and received within an annular recess **68*b* formed in the knob 68. Suitable S-clips 77 may be used to retain the tab 74 within the slot 76 (see FIG. 2). The tubular members 52 of the frame 48 exit from beneath the cover 50 through slots 80 provided in the lowermost edge of the cover 50. Thus, the cover 50 covers the entire back of the support member 60 completely concealing the height adjustment mechanism. As best seen in FIG. 3, the upper legs of the tubular members 52 of the frame 48 are received within apertures 81 of the support member 60 and telescope therein to give the back assembly 14 added support by the frame 48**.

Figure 6:
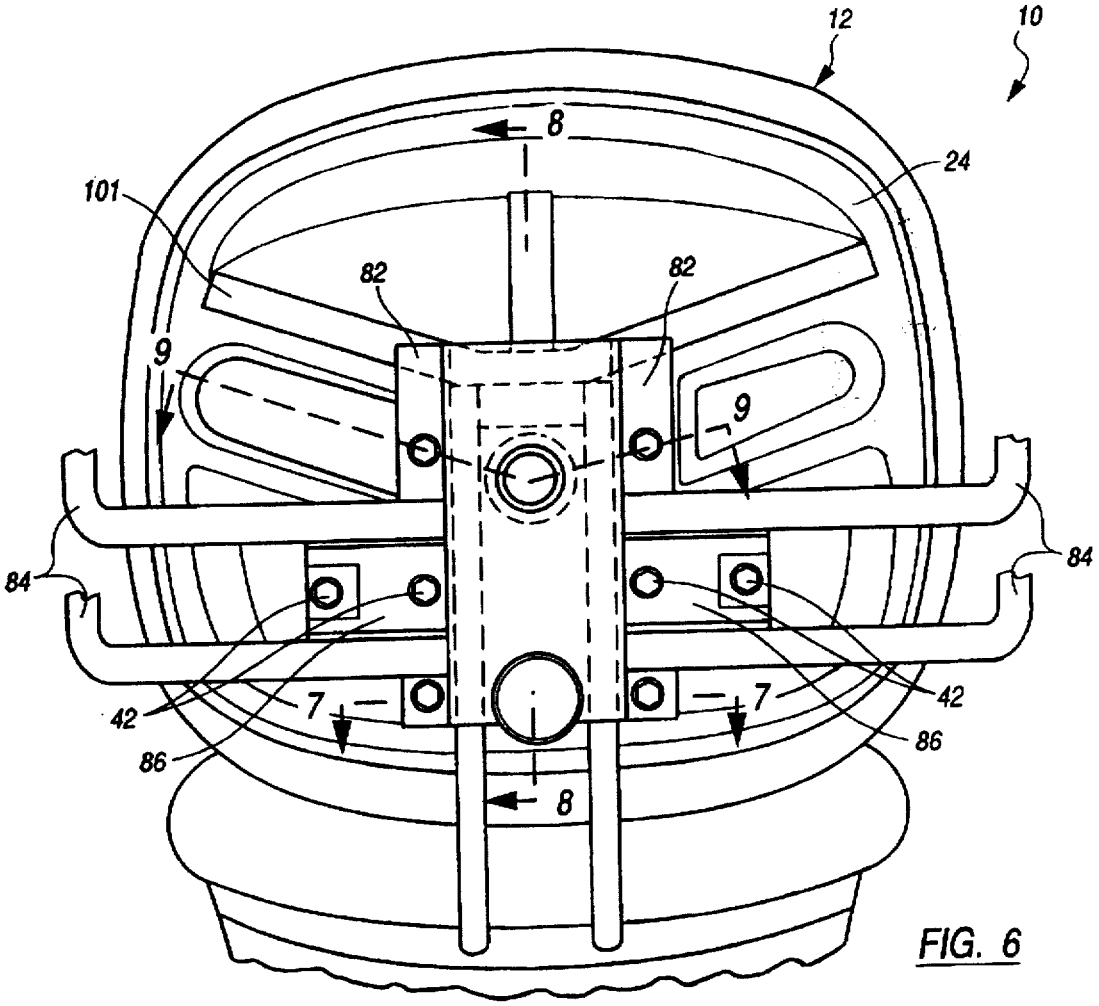
FIG. 6 is a bottom plan view of the chair.
Figure 7:
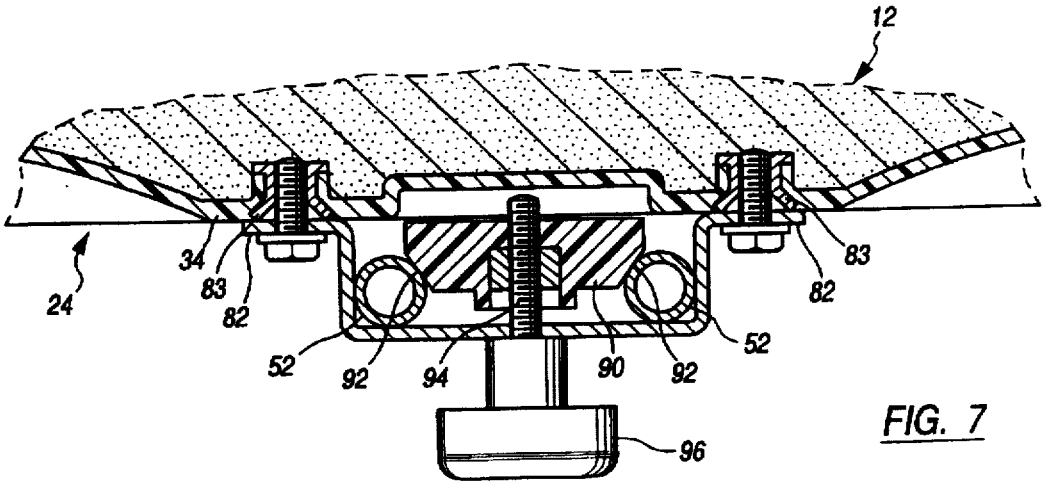
FIG. 7 is a partial cross-sectional view taken substantially along the line 7—7 of FIG. 6.
Figure 8:
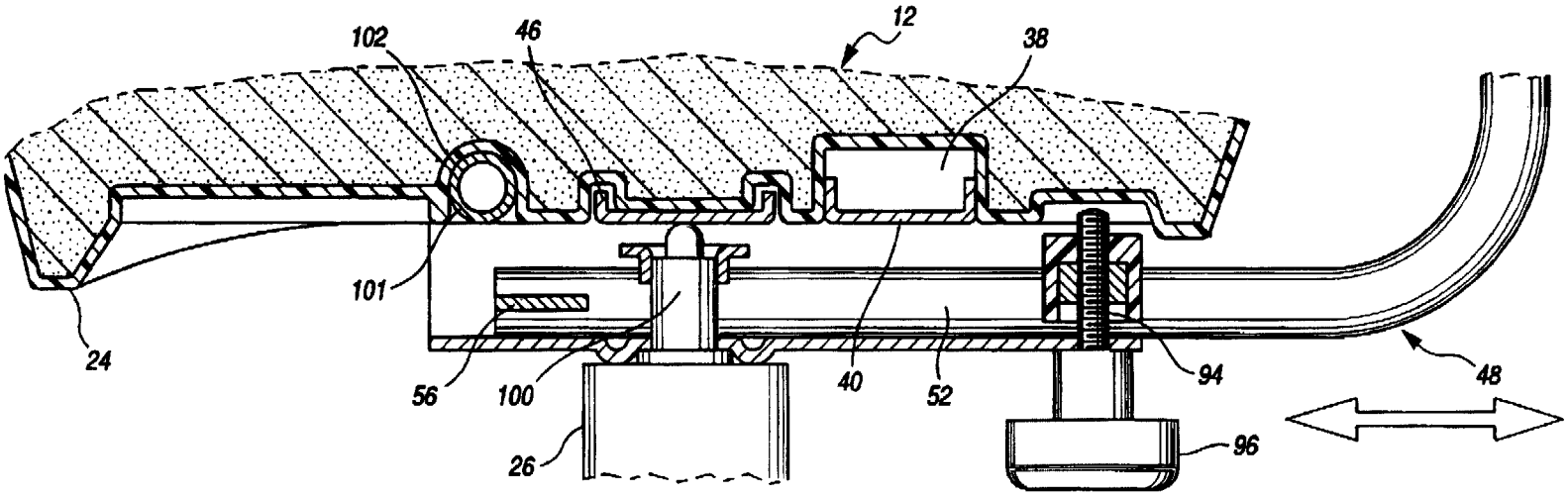
FIG. 8 is a partial cross-sectional view taken substantially along the line 8—8 of FIG. 6.

Turning now to FIGS. 6, 7 and 8, the details of the seat support member 24 can be seen in enlarged illustration. The control bracket 36 has a generally C-shaped cross-section with a pair of opposed outwardly extending flanges 82 for mounting the bracket 36 to the planar portion 34 of the support member 24 by suitable fasteners such as clinch nuts 83. The arm frames 22 comprise a pair of tubes 84 joined at their lowermost ends by webs 86. The bolts 42 fasten the webs 86 to the support member 24 through threaded holes in the cross brace 40 which is positioned in recess 38 beneath the control bracket 36 and beneath the webs 86. For added strength, the spacing of the holes in the cross brace 40 is such that the ends of the arm tubes 84 and associated webs 86 butt up snugly against the respective sides of the control bracket 36.

In accordance with the invention, the seat back 14 of the chair 10 has an out-back adjustment feature which permits the back 14 to be adjusted horizontally with respect to the seat 12. With reference particularly to FIGS. 7 and 8, this feature is accomplished by the telescoping relationship of the back support frame 48 within the control bracket 36. The spacing of the tubular members 52 of the back support frame 48 is such that the members 52 slide in close proximity to the side walls of the control bracket 36. Once the desired out-back position is selected, a clamp bar 90 having ramp surfaces 92 (FIG. 7) is drawn tightly against the tubular members 52 by a bolt 94 connected to a knob 96 which extends through an aperture in the control bracket 36. The clamp bar 90 thereby urges the tubular members 52 into engagement with the interior walls of the control bracket 36 and clamps the members 52 securely thereto. In order to inhibit accidental removal of the frame 48 from the seat assembly 12, the tubular members 52 extend forwardly of gas cylinder 100 and are joined thereat by cross bar 56. Thus, cross bar 56 acts as a stop against the cylinder 100 to prevent complete removal of the frame 48 from the control bracket 36. In order to provide increased support for the seat assembly 12, the control bracket 36 is provided at its forward end with a V-shaped cross tube 101, connected thereto as by welding. The cross tube 101 fits snugly within a V-shaped recess 102 formed in the support member 24 (FIG. 2).

Figure 9:
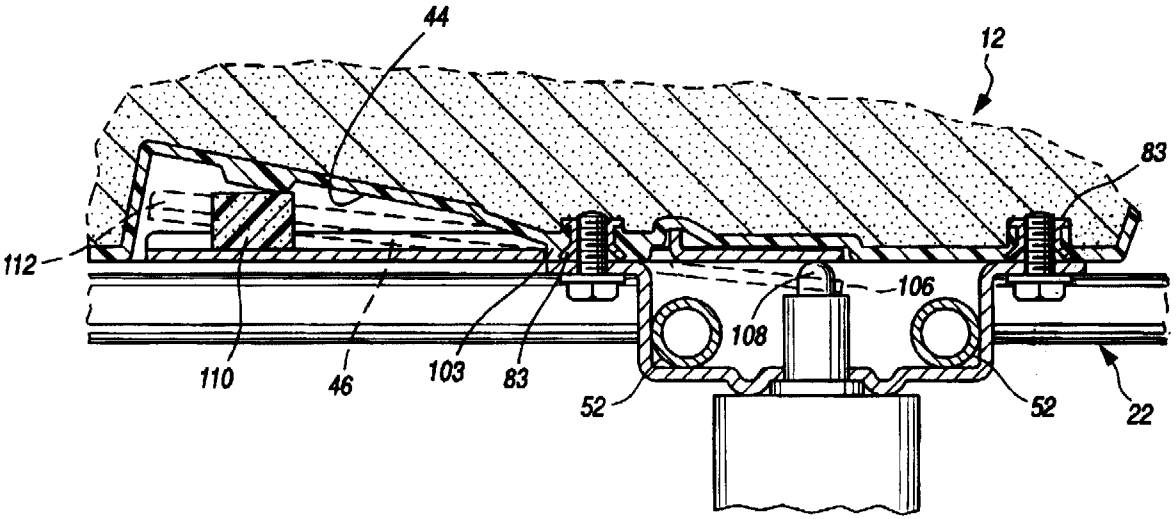
FIG. 9 is a partial cross-sectional view taken substantially along the line 9—9 of FIG. 6.

The chair 10 of the preferred embodiment also has an adjustable seat height feature as best shown in FIG. 9. Disposed within recess 44 of the seat support member 24 is actuator lever 46. A boss 103 formed on the member 24 acts as a fulcrum for pivotable movement of the lever 46, the boss 103 cooperating with an aperture 104 in the lever 46. One of the bolts which fasten the control bracket 36 to the support member 24 cooperates with the boss 103 to trap the lever 46 in position within the recess 44. The lever 46 extends from the center of the control bracket 36 to an edge of the seat 12 and as thus installed, the proximal end 106 of the lever 46 actuates a button 108 on the top of the gas cylinder 100. A resilient foam member 110 may be used to bias the lever 46 to an unactuated position. The gas cylinder 100, which is of conventional well-known design thereby provides for raising and lowering of the seat assembly 12 on the pedestal 26 upon actuation of the lever 46. The user of the chair may operate the lever 46 by reaching under the seat and by manipulating the distal end 112 of the lever against the force of the foam member 110. The use of a foam member 110 also reduces rattling of the actuator lever 46.

It can now be appreciated that the chair 10 of the present invention provides a highly functional yet readily manufactured structure. Moreover, because of the concealed nature of the seat height adjusting lever 46 and the back height adjusting mechanism, the chair has a simple, aesthetically pleasing overall appearance. The chair 10 is also easy to assemble and, therefore, can be readily shipped in disassembled condition for better ease of shipment.

While the present invention has been described in connection with a preferred embodiment thereof, it will be understood by those skilled in the art that many changes and modifications may be made without departing from the true spirit and scope of the invention. Accordingly, it is intended by the appended claims to cover all such changes and modifications which come within the true spirit and scope of this invention.

What is claimed is:

1. An adjustable height back for a chair comprising:

a unitary molded back support member defining a main body member of a back of a chair a frame for connecting the back support member to the seat of a chair, the frame including a pair of parallel spaced tubular members connected by a plate, said plate being provided with a vertical slot;

a pair of channels formed in the back support member, the channels having wedge-shaped side walls and being dimensioned and configured to slidingly receive the tubular members; and a bolt extending through said slot and into a threaded recess of the back support member;

wherein tightening of said bolt urges the tubular members into engagement with the side walls of the channels to clamp the tubular members directly to the back support member.

2. The adjustable height back of claim 1 further including a cover for covering the channels in the back support member.

3. The adjustable height back of claim 2 wherein the tubular members exit the cover along a bottom edge of the cover.

4. An adjustable height back for a chair comprising:

a molded back support member;

a frame for connecting the back support member to the seat of a chair, the frame including a pair of parallel spaced tubular members;

a pair of channels formed in the back support member, the channels having wedge-shaped side walls and being dimensioned and configured to slidingly receive the tubular members;

means for urging the tubular members into engagement with the side walls of the channels to clamp the tubular members to the back support member; and a cover for covering the channels in the back support member, the cover having a tab cooperable with a slot of the back support member to retain the cover in fixed disposition on the back support member.

* * * * *